US011607718B2

(12) United States Patent
Kopin et al.

(10) Patent No.: US 11,607,718 B2
(45) Date of Patent: Mar. 21, 2023

(54) ROLLING MILL STAND

(71) Applicant: ANDRITZ Metals Germany GmbH, Hemer (DE)

(72) Inventors: Fritz Kopin, Großholbach (DE); Heinrich Schulte, Arnsberg (DE)

(73) Assignee: ANDRITZ Metals Germany GmbH, Hemer (DE)

( * ) Notice: Subject to any disclaimer, the term of this patent is extended or adjusted under 35 U.S.C. 154(b) by 0 days.

(21) Appl. No.: 17/333,301

(22) Filed: May 28, 2021

(65) Prior Publication Data

US 2022/0176430 A1 Jun. 9, 2022

(30) Foreign Application Priority Data

Dec. 9, 2020 (AT) ..... A 51070/2020

(51) Int. Cl.
*B21B 13/16* (2006.01)

(52) U.S. Cl.
CPC ..... *B21B 13/16* (2013.01)

(58) Field of Classification Search
CPC ..... B21B 13/16; B21B 13/145; B21B 13/14; B21B 31/08
See application file for complete search history.

(56) References Cited

U.S. PATENT DOCUMENTS 4,531,394 A * 7/1985 Turley ..... B21B 13/145 72/243.4
5,119,656 A * 6/1992 Kobayashi ..... B21B 29/00 72/241.8
7,104,101 B1 9/2006 Berger et al.

* cited by examiner

*Primary Examiner* — Teresa M Ekiert
(74) *Attorney, Agent, or Firm* — Alix, Yale & Ristas, LLP

(57) ABSTRACT

The object of this invention is a rolling mill stand with one pair of work rolls for a rolling metal strip, with intermediate rolls and back-up rolls. Here, the work rolls are supported at the sides by supporting systems, where a supporting force directed towards the work roll can be applied to each supporting system by means of a force generating device and the supporting system can be moved from an idle position into an operating position. According to the invention, the two work rolls can be replaced by work rolls with a different diameter, where only the supporting systems have to be replaced by supporting systems with supporting rolls of a different diameter, but the intermediate rolls and back-up rolls need not be changed.

20 Claims, 3 Drawing Sheets

ROLLING MILL STAND

BACKGROUND

The disclosed embodiments relate to a rolling mill stand with a pair of work rolls for rolling high-strength metal strip (e.g. UHSS, AHSS). More specifically, the rolling mill stand includes four lateral supporting systems to which a supporting force can be applied by means of a force generating device with a supporting force directed towards the work rolls. Each supporting system has a supporting roll, roller bearings and at least one part of a support beam. The work rolls are supported by intermediate and back-up rolls in a direction that is perpendicular to the strip surface. The intermediate rolls and preferably also the back-up rolls are carried on a roll chock that can slide into and out of the rolling mill stand in the direction of its longitudinal axis.

With a rolling mill stand of this kind, the rolls in the stand can be changed faster and more easily because the supporting systems can be moved from an idle position, where they are disposed outside of the area in which the roll chock of the intermediate roll moves when being pushed out and in, into an operating position in which they rest on the work roll.

A rolling mill stand of this kind is described in DE 199 44 612 C1.

By means of the force generating device, the supporting systems are moved out of the movement range of the roll chock carrying the intermediate roll and any back-up rolls there may be. In this way, the roll chock with the rolls it carries can be removed from the rolling mill stand, serviced and pushed back in independently of the supporting rolls. Similarly, it is possible to service or replace the supporting rolls independently of the rolls in the roll chock.

Due to the dimensions of the intermediate and supporting rolls as well as of the roller bearings and the related movement area of the supporting rolls, which is limited due to collision with the intermediate roll, the diameter range (stock removal range) that can be used for the work rolls is limited. For even higher-strength rolling materials, the minimum possible work roll diameter is too large to achieve an economical production output in conventional rolling mill stands (S6-High™ rolling mill stands). In order to also be able to roll even higher-strength steel grades in conventional rolling mill stands, it has been necessary to change to a 20-high stand with smaller work rolls.

It would thus be useful to have a rolling mill stand of the kind described above wherein a larger diameter range (stock removal range) can be used for the work rolls than is provided by the state of the art, so that work rolls with different diameters can be used in a single rolling mill stand, thus being able to roll a broader spectrum of steel grades, especially highest-strength steels. Changing to other work rolls would accordingly be particularly easy.

SUMMARY

Disclosed herein is a rolling mill stand with two work rolls that can be replaced with work rolls of a different diameter, where only the four supporting systems have to be replaced by supporting systems with different supporting roll diameters, without the back-up or intermediate rolls having to be changed.

Hence, the diameter range of the work rolls is split between at least two overlapping diameter ranges, where each diameter range is assigned its supporting system. This supporting system is then also changed when the work rolls are changed if the new diameter of the work roll so requires due to a change in the diameter ranges. As a rule, supporting systems with smaller supporting rolls are deployed if smaller work rolls are used.

The particular arrangement of the supporting rolls enables high formability and hence high production outputs, also when using the small roll diameters.

The two different supporting systems are moved from the idle to the operating position preferably by the same force generating device, for example a hydraulic or pneumatically operated positioning cylinder.

However, the force generating device can also be a mechanically adjustable spindle.

The support beams are preferably divided into two detachable parts that are joined together in the longitudinal direction of the supporting roll, where the first part carries the supporting roll and the second part is coupled with the force generating device. In this way, the supporting roll carried by the respective support beam can be changed particularly quickly and easily. This is especially true when the part carrying the supporting roll is held at the second part of the support beam such that it can be moved in the longitudinal direction of the part.

It is also possible to dispose the roller bearings at regular intervals along the supporting roll.

BRIEF DESCRIPTION OF THE DRAWINGS

The invention will be described below in more detail, referring to drawings, wherein elements with identical functions have the same reference numerals.

DETAILED DESCRIPTION

Figure 1:
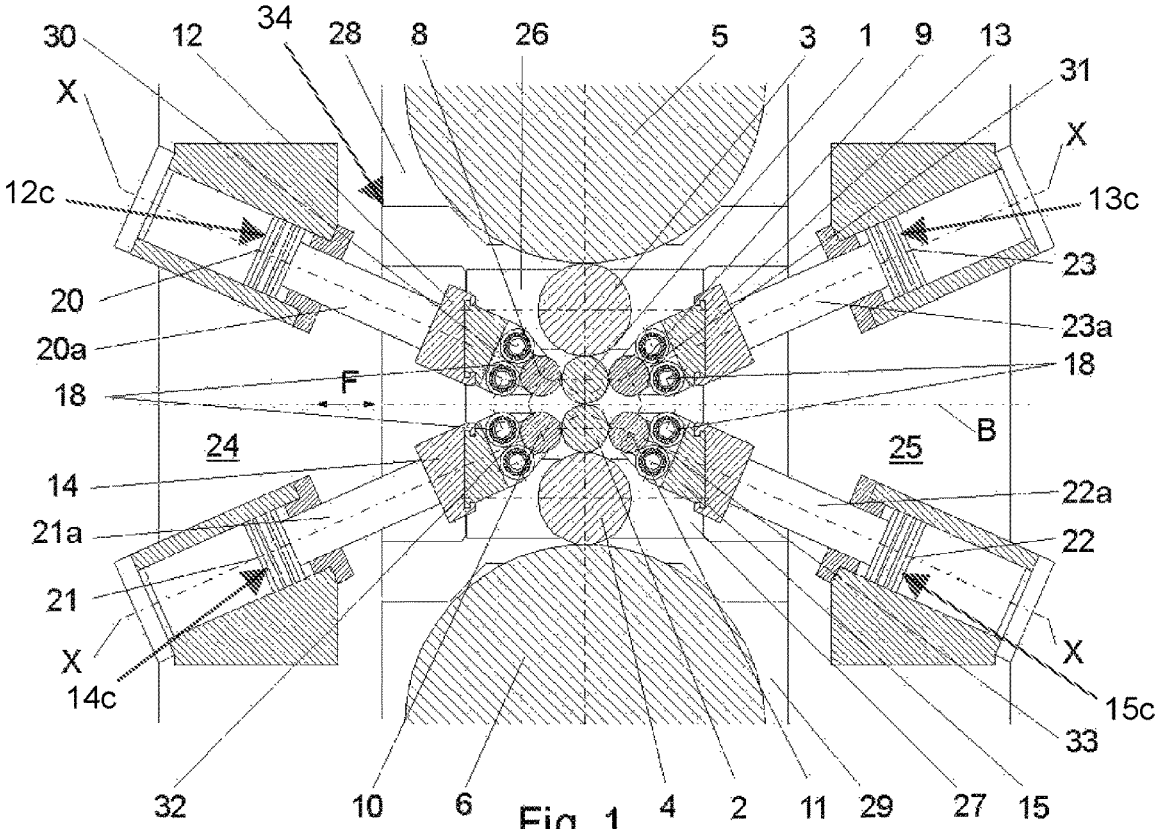
FIG. 1 shows a detail of a rolling mill stand according to the invention, with large work rolls and large supporting rolls in profile in the operating position and in the conveying direction F of the rolled metal strip B.
Figure 1A:
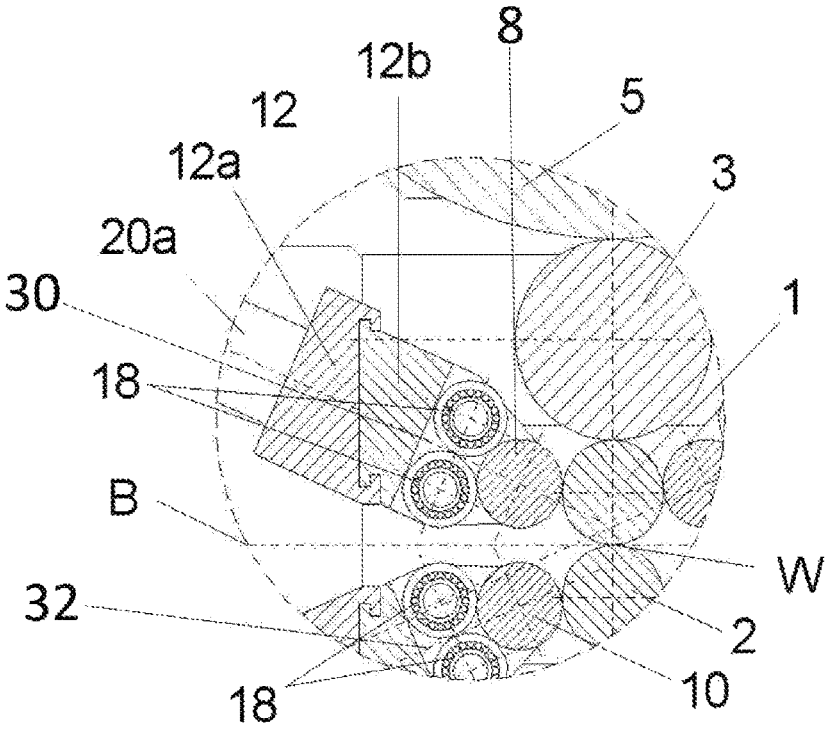
FIG. 1A shows an enlarged view of a detail from FIG. 1.

The rolling mill stand has two work rolls 1, 2. The work rolls 1, 2 are each supported vertically via one intermediate roll 3, 4 on one back-up roll 5, 6 whose axis of rotation lies on the same plane as the axes of rotation of the work rolls 1, 2 and the intermediate rolls 3, 4. The intermediate rolls 3, 4 are held in a roll chock 26, 27 and the back-up rolls 5, 6 in a separate roll chock 28, 29, while the work rolls 1, 2 are held loosely in the rolling mill stand. A roll gap W in which the metal strip B is cold-rolled in a conveying direction F is formed between the work rolls 1, 2.

The roll chock 26, 27 is mounted movably on a guide track of a frame 34 that is only generally shown in the Figures, and can be pulled out of the frame of the respective rolling mill stand in its longitudinal direction, axially parallel to the axes of rotation of the work, intermediate and back-up rolls Two supporting systems 30, 31, 32, 33 comprising supporting rolls 8, 9, 10, 11, roller bearings 18 and parts 12*b*, 13*b*, 14*b*, 15*b* of a support beam 12, 13, 14, 15 are assigned to each work roll 1, 2. Here, the work rolls 1,2, are each supported on either side by one supporting system each 30, 31, 32, 33, The supporting rolls 8, 9, 10, 11 are each carried on a support beam 12, 13, 14, 15.

The four support beams 12, 13, 14, 15 are split into two parts 12*a*, 13*a*, 14*a*, 15*a* and 12*b*, 13*b*, 14*b*, 15*b*, where the dividing plane is preferably vertical and extends in parallel to the plane in which the axes of rotation of the work rolls 1, 2, the intermediate rolls 3, 4 and the back-up rolls 5, 6 lie. Here, the second part 12*b*, 13*b*, 14*b*, 15*b* of the respective support beam 12, 13, 14, 15 carries the respective supporting roll 8, 9, 10, and 11 assigned to this support beam 12, 13, 14, 15. A T-shaped guideway formed at the respective first part 12*a*, 13*a*, 14*a*, 15*a* attaches the respective second part 12*b*, 13*b*, 14*b*, 15*b* to the first part 12*a*, 13*a*, 14*a*, 15*a* in a way allowing it to be moved in its longitudinal direction so that it can be pulled out of the respective rolling mill stand together with the supporting roll 8, 9, 10, 11 that it carries.

In the embodiment example, roller bearings 18 are disposed at regular intervals on the support beams 12, 13, 14, 15 along the supporting rolls 8, 9, 10, and 11, respectively, in order to support the supporting rolls 8, 9, 10, and 11, respectively, at the sides. The roller bearings 18 are also supported on the respective support beam 12, 13, 14, 15.

At regular intervals along the respective support beam 12, 13, 14, 15, several well-placed hydraulically, mechanically or pneumatically operated positioning cylinders 20, 21, 22, 23, which are secured to the columns 24 and 25, respectively, of the rolling mill stand disposed at the side of the roll chock 28, 29, are assigned to each support beam 12, 13, 14, 15. The pistons 20*a*, 21*a*, 22*a*, 23*a* of the positioning cylinders 20, 21, 22, 23 are coupled with the first part 12*a*, 13*a*, 14*a*, 15*a* of the respective support beam 12, 13, 14 and 15. The movement axes X of the pistons 20*a*, 21*a*, 22*a*, 23*a* are each disposed on a slant in the direction of the roll gap W.

Figure 3:
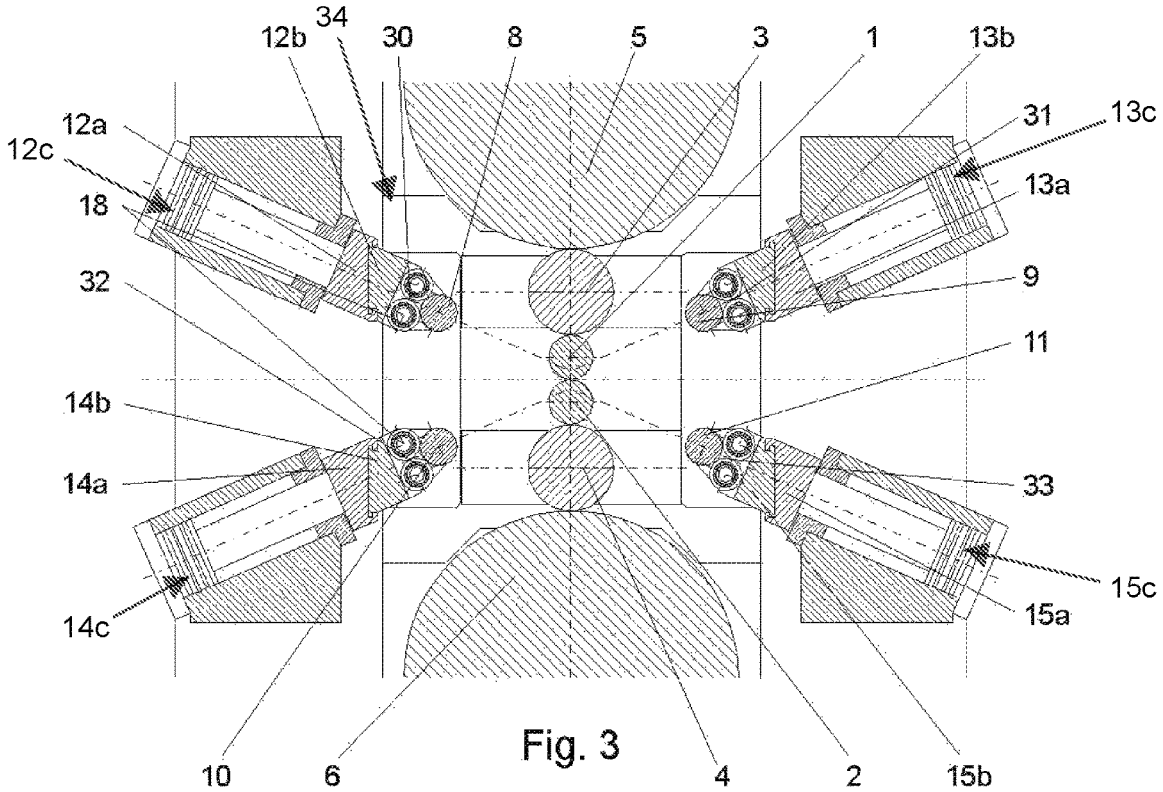
FIG. 3 shows the rolling mill stand according to FIG. 1 in the idle position.
Figure 4:
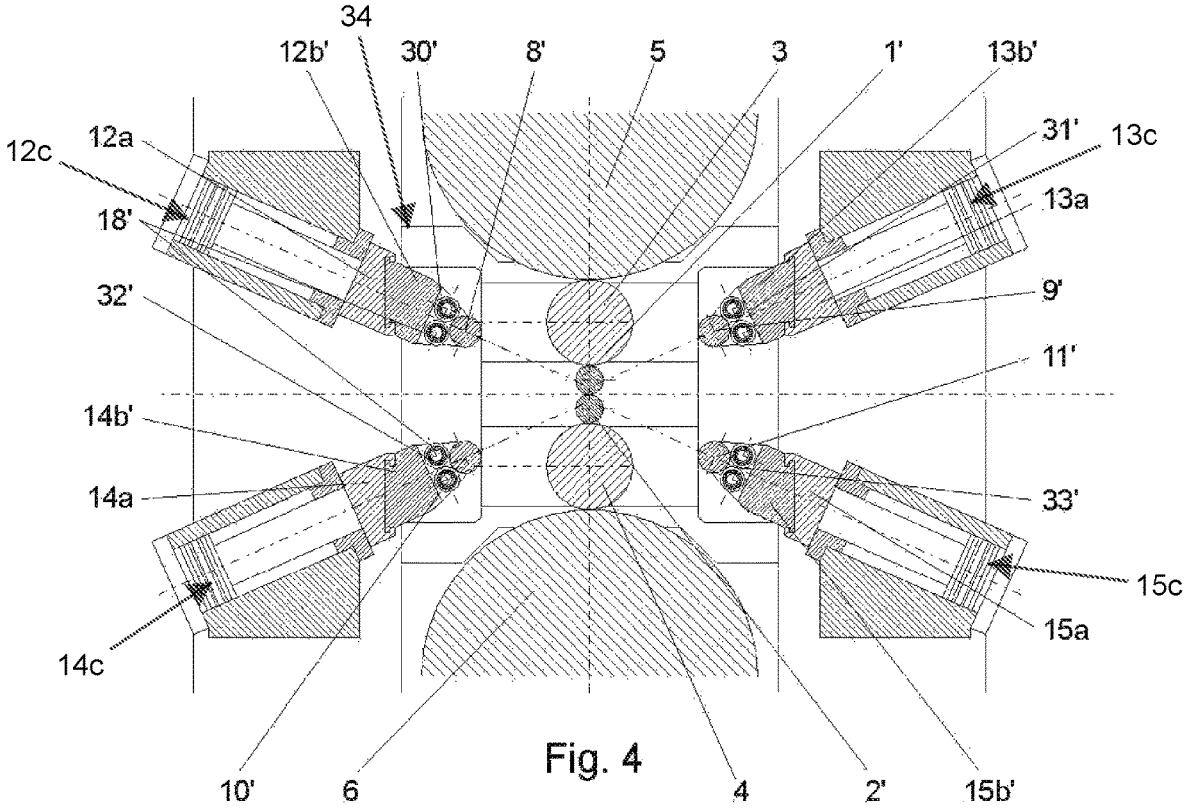
FIG. 4 shows the rolling mill stand according to FIG. 2 in the idle position.

There is a free space in each case between the respective mounting location of the positioning cylinders 20, 21, 22, 23 and the space in which the roll chock 26, 27 is moved when being pushed in and out. The depth and displacement path of the pistons 20*a*, 21*a*, 22*a*, 23*a* are each calculated such that the support beams 12, 13, 14, 15 the pistons each carry with the supporting rolls 8, 9, 10 and 11, respectively, are in this free space when the pistons 21*a*, 21*a*, 22*a*, 23*a* are fully retracted (FIG. 3, FIG. 4). In this position (idle position) of the pistons 20*a*, 21*a*, 22*a*, 23A and the support beams 12, 13, 14, 15 to which they are connected, the roll chock 26, 27 with the intermediate rolls 3, 4 that it supports can be pulled out of the rolling mill stand without the risk of a collision with the supporting rolls 8, 9, 10, 11.

In order to change the supporting rolls 8, 9, 10, 11, the respective second part 12*b* in each case is pulled along the guide rail of the respective first part 12*a* of the support beams 12, 13, 14, 15. The first part 12*a* is connected to the respective assigned piston 20*a*, 21*a*, 22*a*, and 23*a*. On the one hand, this can be done when the roll chock 26, 27 has been pulled out. For this purpose, the supporting rolls 8, 9, 10, 11 with the support beams 12, 13, 14, 15 are run into the respective free space so that the roll chock 26, 27 can be pulled unhindered out of the frame 34 of the rolling mill stand.

As an alternative, the supporting rolls 8, 9, 10, 11 can also be pulled out of the rolling mill stand together with the roll chocks 26, 27. For this purpose, the support beams 12, 13, 14, 15 are run into a position in which their respective T-guideway is arranged flush with the respective outer edge of the roll chock 26, 27 (see FIG. 1). When the roll chock 26, 27 is pulled out, the parts 12*b*, 13*b*, 14*b*, 15*b* of the support beams 12, 13, 14, 15, and with them the respective supporting roll 8, 9, 10, 11, are pulled out of the rolling mill stand together with the roll chocks 26, 27. In this way, the roll chocks 26, 27 serve as an aid to mounting and dismounting that obviates the need for a special auxiliary device of this kind.

When the supporting rolls 8, 9, 10, 11 are resting on the work rolls 1, 2, the positioning cylinders 20, 21, 22, 23 generate the supporting force that supports the supporting rolls 8, 9, 10, 11 via the roller bearings 18 on their side facing away from the respective work roll 1, 2. The supporting forces emitted by the individual positioning cylinders 20, 21, 22, 23 disposed along the respective support beam 12, 13, 14, 15 can be set here, for example, such that a specific geometry is achieved in the roll gap W due to the corresponding deflection of the respective supporting rolls 8, 9, 10, 11 and work roll 1, 2, respectively.

Figure 2:
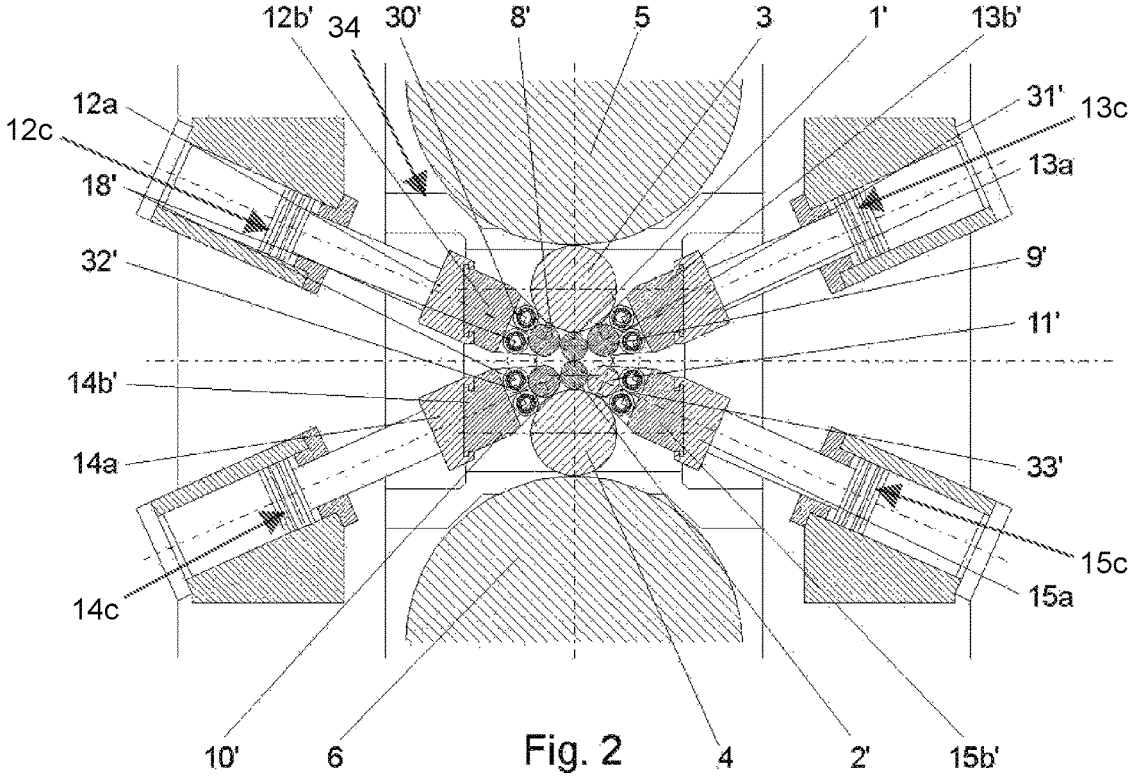
FIG. 2 shows the rolling mill stand according to FIG. 1, but with small work rolls and small supporting rolls in the operating position.

The rolling mill stand can now be retooled with smaller work rolls 1', 2' without any difficulty. The rolling mill stand from FIG. 1 is shown with smaller work rolls 1', 2' in FIGS. 2 and 4.

In order to replace the work rolls 1, 2 with smaller work rolls 1', 2', the lateral supporting systems 30, 31, 32, 33 are moved into the front end position, i.e. a position in which the respective T-guideway of the support beams 12, 13, 14, 15 is flush with the respective outer edge of the roll chocks 26, 27, as described above.

Then the lateral supporting systems 30, 31, 32, 33 and the roll chocks 26, 27 are pulled out of the frame 34 of the rolling mill stand. The first parts 12*a*, 13*a*, 14*a*, 15*a* of the support beams 12, 13, 14, 15 are connected permanently to the force generating devices (12*c*, 13*c*, 14*c*, 15*c*) and remain in the rolling mill stand. Then four supporting systems 30', 31', 32', 33' with smaller supporting rolls 8', 9', 10', 11' are pushed into the rolling mill stand together with the roll chocks 26, 27. In the present example, these supporting systems 30', 31', 32', 33' comprise the smaller supporting rolls 8', 9', 10', 11', correspondingly smaller roller bearings 18' for the supporting rolls 8', 9', 10', 11', and corresponding second parts 12*b*', 13*b*', 14*b*', 15*b*' of the support beams that hold the smaller supporting rolls 8', 9', 10', 11' and roller bearings 18' and which can be pushed into the guide rail of the first parts 12*a*, 13*a*, 14*a*, 15*a* of the support beams 12, 13, 14, 15. As supporting systems 30', 31', 32', 33' with smaller supporting rolls 8', 9', 10', 11' are now used here, smaller work rolls 1', 2' can also be inserted into the rolling mill stand without there being any collision by the supporting systems 30', 31', 32', 33' and the intermediate rolls 3, 4. Hence, the intermediate rolls 3, 4 can remain in the rolling mill stand when it has been retooled this way and need not be changed. Nor do the back-up rolls 5, 6 need to be changed.

LIST OF REFERENCE NUMERALS 1, 2 work rolls;
1', 2' work rolls with smaller diameter;
3, 4 intermediate rolls;
5, 6 back-up rolls;
8, 9, 10, 11 supporting rolls for work rolls 1, 2;
8', 9', 10', 11' supporting rolls for smaller work rolls 1', 2';
12, 13, 14, 15 support beams;
12*a*, 13*a*, 14*a*, 15*a* first part of the support beam 12, 13, 14, 15
12*b*, 13*b*, 14*b*, 15*b* second part of the support beam 12, 13, 14, 15 with roller bearings 18 and supporting rolls 8, 9, 10, 11;
12*c*, 13*c*, 14*c*, 15*c* force generating devices;

12*b*', 13*b*', 14*b*', 15*b*' second part of the support beams with roller bearings 18' and supporting rolls 8', 9', 10', 11';
18 roller bearings
18' roller bearings for work rolls 8', 9', 10', 11';
20, 21, 22, 23 positioning cylinders;
20*a*, 21*a*, 22*a*, 23*a* pistons;
24, 25 columns of the rolling mill stand;
26, 27 roll chock of the intermediate rolls 3, 4;
28, 29 roll chock of the back-up rolls 5, 6;
30, 31, 32, 33 supporting system for work rolls 1, 2;
34 frame;
30', 31', 32', 33' supporting system for smaller work rolls 1', 2';
B metal strip
F conveying direction;
w roll gap;
X movement axis of pistons 20*a*, 21*a*, 22*a*, 23*a*

The invention claimed is:

1. A rolling mill stand, comprising:

a frame (34);

a pair of work rolls (1, 2) for rolling a metal strip (B) with a surface, each work roll (1, 2) having a first diameter;

a pair of intermediate rolls (3, 4) each defining an axis, each of the intermediate rolls (3, 4) supporting one of the work rolls (1, 2) in a direction substantially perpendicular to the surface of the metal strip (B) and being carried in a respective roll chock (26, 27) that is movable into and out from the frame (34) in the direction of the axis of the respective intermediate roll (3, 4) that it carries;

a pair of back-up rolls (5, 6), each of the back-up rolls (5, 6) supporting one of the intermediate rolls (3, 4);

four first supporting systems (30, 31, 32, 33) laterally supporting the respective work rolls (1, 2);

a force generating device (12*c*, 13*c*, 14*c*, 15*c*) associated with each supporting system (30, 31, 32, 33), wherein a supporting force can be applied to each supporting system (30, 31, 32, 33) via a respective force generating device (12*c*, 13*c*, 14*c*, 15*c*) providing a supporting force in a directing towards a respective work roll (1, 2), each supporting system (30, 31, 32, 33) includes a respective supporting roll (8, 9, 10, 11) having a third diameter and defining an axis, roller bearings (18) and at least one part (12*b*, 13*b*, 14*b*, 15*b*) of a support beam (12, 13, 14, 15), each supporting system (30, 31, 32, 33) is movable from an idle position disposed outside of an area in which the roll chocks (26, 27) of the intermediate rolls (3, 4) move when being pushed in and pulled out, into an operating position in which the respective supporting roll (8, 9, 10, 11) rests on a respective work roll (1, 2), each of the two work rolls (1, 2) is configured for replacement by an alternate work roll (1', 2') having a second diameter different from the first diameter, and to accommodate the alternate work rolls (1', 2'), the supporting systems (30, 31, 32, 33) are configured for replacement by alternate supporting systems (30', 31', 32', 33') with alternate supporting rolls (8', 9', 10', 11') defining an axis and having a fourth diameter different from the third diameter without requiring replacement of intermediate rolls (3, 4) and back-up rolls (5, 6).

2. The rolling mill stand according to claim 1, wherein when the two work rolls (1, 2) are replaced by alternate work rolls (1', 2') of a third diameter smaller than the first diameter, the four supporting systems (30, 31, 32, 33) are replaced by supporting systems (30', 31', 32', 33') with supporting rolls (8', 9', 10', 11') having a fourth diameter smaller than the second diameter.

3. The rolling mill stand according to claim 1, wherein each of the force generating devices (12*c*, 13*c*, 14*c*, 15*c*) is configured to move at least one additional supporting system (30', 31', 32', 33') that is differently sized from the respective first supporting system (30, 31, 32, 33) from the idle position into the operating position.

4. The rolling mill stand according to claim 1, wherein one or more of the force generating devices (12*c*, 13*c*, 14*c*, 15*c*) has hydraulically or pneumatically operated positioning cylinders (20, 21, 22, 23).

5. The rolling mill stand according to claim 1, wherein one or more of the force generating devices (12*c*, 13*c*, 14*c*, 15*c*) has a mechanically adjustable spindle.

6. The rolling mill stand according to claim 1, wherein in each supporting system (30, 31, 32, 33, 30', 31', 32', 33'), the respective supporting roll (8, 9, 10, 11, 8', 9', 10', 11') is carried by at least one part of the respective support beam (12*b*, 13*b*, 14*b*, 15*b*, 12*b*', 13*b*', 14*b*', 15*b*') and supported in roller bearings (18, 18'), and each of the force generating devices (12*c*, 13*c*, 14*c*, 15*c*) acts upon the part of the respective support beam (12*b*, 13*b*, 14*b*, 15*b*, 12*b*', 13*b*', 14*b*', 15*b*').

7. The rolling mill stand according to claim 6, wherein the roller bearings (18, 18') are disposed at regular intervals along the respective supporting roll (8, 9, 10, 11, 8', 9', 10', 11').

8. The rolling mill stand according to claim 1, wherein the support beam (12, 13, 14, 15) is split in a longitudinal direction parallel to the axis of the respective supporting roll (8, 9, 10, 11, 8', 9', 10', 11') into two detachable parts that are connected to one another (12*a*, 13*a*, 14*a*, 15*a*, 12*b*, 13*b*, 14*b*, 15*b*, 12*b*', 13*b*', 14*b*', 15*b*'), a first part (12*a*, 13*a*, 14*a*, 15*a*) being coupled with the force generating device (12*c*, 13*c*, 14*c*, 15*c*) and a second part (12*b*, 13*b*, 14*b*, 15*b*, 12*b*', 13*b*', 14*b*', 15*b*') carrying the supporting roll (8, 9, 10, 11, 8', 9', 10', 11').

9. The rolling mill stand according to claim 8, wherein the respective second part (12*b*, 13*b*, 14*b*, 15*b*, 12*b*', 13*b*', 14*b*', 15*b*') that carries the respective supporting roll (8, 9, 10, 11, 8', 9', 10', 11') is attached to the first part (12*a*, 13*a*, 14*a*, 15*a*) of the support beam (12, 13, 14, 15) such that it is movable in the longitudinal direction.

10. The rolling mill stand according to claim 1, wherein numerous force generating devices (12*c*, 13*c*, 14*c*, 15*c*) are disposed with interspacing along one or more of the support beams (12, 13, 14, 15).

11. The rolling mill stand according to claim 2, wherein each of the force generating devices (12*c*, 13*c*, 14*c*, 15*c*) is configured to move at least one additional supporting system (30', 31', 32', 33') that is differently sized from the respective first supporting system (30, 31, 32, 33) from the idle position into the operating position.

12. The rolling mill stand according to claim 2, wherein in each supporting system (30, 31, 32, 33, 30', 31', 32', 33'), the respective supporting roll (8, 9, 10, 11, 8', 9', 10', 11') is carried by at least one part of the respective support beam (12*b*, 13*b*, 14*b*, 15*b*, 12*b*', 13*b*', 14*b*', 15*b*') and supported in roller bearings (18, 18'), and each of the force generating devices (12*c*, 13*c*, 14*c*, 15*c*) acts upon the part of the respective support beam (12*b*, 13*b*, 14*b*, 15*b*, 12*b*', 13*b*', 14*b*', 15*b*').

13. The rolling mill stand according to claim 12, wherein the roller bearings (18, 18') are disposed at regular intervals along the respective supporting roll (8, 9, 10, 11, 8', 9', 10', 11').

14. The rolling mill stand according to claim 2, wherein the support beam (12, 13, 14, 15) is split in a longitudinal direction parallel to the axis of the respective supporting roll (8, 9, 10, 11, 8', 9', 10', 11') into two detachable parts that are connected to one another (12*a*, 13*a*, 14*a*, 15*a*, 12*b*, 13*b*, 14*b*, 15*b*, 12*b*', 13*b*', 14*b*', 15*b*'), a first part (12*a*, 13*a*, 14*a*, 15*a*) being coupled with the force generating device (12*c*, 13*c*, 14*c*, 15*c*) and a second part (12*b*, 13*b*, 14*b*, 15*b*, 12*b*', 13*b*', 14*b*', 15*b*') carrying the supporting roll (8, 9, 10, 11, 8', 9', 10', 11').

15. The rolling mill stand according to claim 14, wherein the respective second part (12*b*, 13*b*, 14*b*, 15*b*, 12*b*', 13*b*', 14*b*', 15*b*') that carries the respective supporting roll (8, 9, 10, 11, 8', 9', 10', 11') is attached to the first part (12*a*, 13*a*, 14*a*, 15*a*) of the support beam (12, 13, 14, 15) such that it is movable in the longitudinal direction.

16. The rolling mill stand according to claim 11, wherein the support beam (12, 13, 14, 15) is split in a longitudinal direction parallel to the axis of the respective supporting roll (8, 9, 10, 11, 8', 9', 10', 11') into two detachable parts that are connected to one another (12*a*, 13*a*, 14*a*, 15*a*, 12*b*, 13*b*, 14*b*, 15*b*, 12*b*', 13*b*', 14*b*', 15*b*'), a first part (12*a*, 13*a*, 14*a*, 15*a*) being coupled with the force generating device (12*c*, 13*c*, 14*c*, 15*c*) and a second part (12*b*, 13*b*, 14*b*, 15*b*, 12*b*', 13*b*', 14*b*', 15*b*') carrying the supporting roll (8, 9, 10, 11, 8', 9', 10', 11').

17. The rolling mill stand according to claim 15, wherein when the two work rolls (1, 2) are replaced by alternate work rolls (1', 2') of a third diameter smaller than the first diameter, the four supporting systems (30, 31, 32, 33) are replaced by supporting systems (30', 31', 32', 33') with supporting rolls (8', 9', 10', 11') having a fourth diameter smaller than the second diameter.

18. The rolling mill stand according to claim 2, wherein at least one of the force generating devices (12*c*, 13*c*, 14*c*, 15*c*) has hydraulically or pneumatically operated positioning cylinders (20, 21, 22, 23).

19. The rolling mill stand according to claim 2, wherein at least one of the force generating devices (12*c*, 13*c*, 14*c*, 15*c*) has a mechanically adjustable spindle.

20. The rolling mill stand according to claim 4, wherein in each supporting system (30, 31, 32, 33, 30', 31', 32', 33'), the respective supporting roll (8, 9, 10, 11, 8', 9', 10', 11') is carried by at least one part of the respective support beam (12*b*, 13*b*, 14*b*, 15*b*, 12*b*', 13*b*', 14*b*', 15*b*') and supported in roller bearings (18, 18'), and each of the force generating devices (12*c*, 13*c*, 14*c*, 15*c*) acts upon the part of the respective support beam (12*b*, 13*b*, 14*b*, 15*b*, 12*b*', 13*b*', 14*b*', 15*b*').

* * * * *